US009236201B2

(12) United States Patent
Wirz

(10) Patent No.: US 9,236,201 B2
(45) Date of Patent: Jan. 12, 2016

(54) ELECTRICAL SNAP-ACTION SWITCH

(75) Inventor: Paul Wirz, Forstinning (DE)

(73) Assignee: SCHALTBAU GMBH, Munich (DE)

( * ) Notice: Subject to any disclaimer, the term of this patent is extended or adjusted under 35 U.S.C. 154(b) by 40 days.

(21) Appl. No.: 14/005,819

(22) PCT Filed: Jan. 27, 2012

(86) PCT No.: PCT/EP2012/000381

§ 371 (c)(1),
(2), (4) Date: Sep. 17, 2013

(87) PCT Pub. No.: WO2012/123052

PCT Pub. Date: Sep. 20, 2012

(65) Prior Publication Data

US 2014/0001020 A1 Jan. 2, 2014

(30) Foreign Application Priority Data

Mar. 17, 2011 (DE) ..... 10 2011 014 294

(51) Int. Cl.

| | |
|---|---|
| ***H01H 5/30*** | (2006.01) |
| ***H01H 1/20*** | (2006.01) |
| ***H01H 5/04*** | (2006.01) |
| ***H01H 13/22*** | (2006.01) |
| ***H01H 13/36*** | (2006.01) |

(52) U.S. Cl.

CPC ..... *H01H 5/30* (2013.01); *H01H 1/2025* (2013.01); *H01H 5/04* (2013.01); *H01H 13/22* (2013.01); *H01H 13/36* (2013.01)

(58) Field of Classification Search

CPC ..... H01H 5/12; H01H 5/18; H01H 5/20; H01H 2001/0005; H01H 1/36; H01H 15/18; H01H 65/30; H01H 15/20; H01H 5/22; H01H 5/26; H01H 5/28; H01H 5/30

See application file for complete search history.

(56) References Cited

U.S. PATENT DOCUMENTS 3,973,094 A 8/1976 Kuhn
2002/0148713 A1 * 10/2002 Nickerson et al. ..... 200/447

FOREIGN PATENT DOCUMENTS

DE 2618312 A1 11/1977
DE 29614028 U1 12/1997

OTHER PUBLICATIONS

International Search Report mailed May 7, 2012 in Application No. PCT/EP2012/000381.

* cited by examiner

*Primary Examiner* — Edwin A. Leon
*Assistant Examiner* — Anthony R. Jimenez
(74) *Attorney, Agent, or Firm* — Kilpatrick Townsend & Stockton LLP

(57) ABSTRACT

An electrical snap-action switch with a contact link which can be actuated via a switching plunger and a bistable spring and which is connectable in a first switching position to at least one first contact pair and in a second switching position to at least one second contact pair. The spring arrangement on both sides of the switching plunger has at least one spring arm, via which the contact link is movable transversely with respect to the movement direction of the switching plunger up to a movement end position in the event of breakage of one of the spring arms. A sliding ramp is provided in the movement path of the contact link, which sliding ramp spaces apart at least one contact of the contact link in the movement end position from the associated contact of the respective contact pair in the event of breakage of one spring arm.

16 Claims, 3 Drawing Sheets

ELECTRICAL SNAP-ACTION SWITCH

Figure 1:
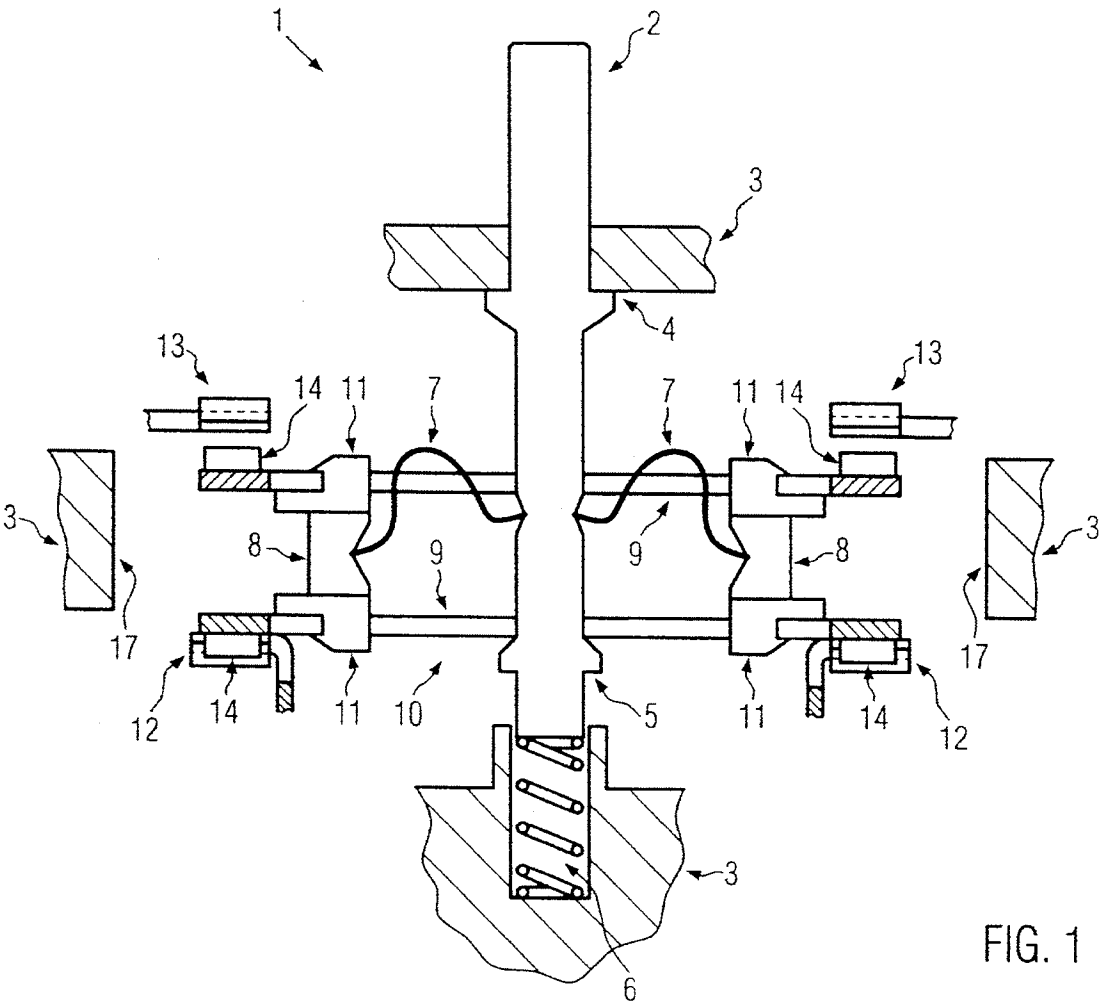

This application is a U.S. National Phase under 35 USC 371 of PCT Application No. PCT/EP2012/000381 filed Jan. 27, 2012, which claims priority to the German Application No. 10 2011 014 294.0, filed Mar. 17, 2011, the disclosures of which are incorporated by reference herein.

The invention relates to an electrical snap-action switch, comprising a contact bridge which can be actuated by a switching plunger and a bistable spring arrangement and which is connectable in a first switch position to at least one first contact pair and in a second switch position to at least one second contact pair, wherein the spring arrangement has at least one spring arm on both sides of the switching plunger, by means of which, in addition, the contact bridge is movable transversely with respect to the movement direction of the switching plunger up to a movement end position in the event of breakage of one of the spring arms.

Numerous electrical snap-action switches are known in the state of the art, in which contact pairs separated from each other are each connectable to each other in one of two switch positions by a contact bridge. The position of the contact bridge is influenced by an actuating unit which, in most cases, comprises a switching plunger disposed and movable transversely to the contact bridge as well as a spring arrangement which can be operated by this switching plunger. Further, the spring arrangement is directly connected to the contact bridge. In this case, different spring assemblies have already been implemented, wherein specifically a bistable spring arrangement with two spring arms has proved to be particularly suitable. A suitable design and arrangement of the spring arms of these bistable spring assemblies allows a temporary switching from a first to a second switch position if a certain switchover point is exceeded, wherein a first contact pair is connected to each other by the contact bridge in the first switch position and a second contact pair in the second switch position.

As the contact bridge and the contacts of the contact pairs of such snap-action switches may be subjected to an undesired bonding due to a thermal overload of the contact areas, lever elements for a forced opening are furthermore provided in some cases of application. These lever elements can mostly be pivoted by the switching plunger, and one end thereof can be placed against the contact bridge. If sufficient force is applied to the switching plunger the contact bridge is pressed away from the contacts, thus resulting in a forced opening of the switch position. For realizing one of the switch positions as a rest position an additional spring element can be integrated in the snap-action switch such that the position of the contact bridge is stabilized in this rest position by the action of the force of this spring member.

However, the above-mentioned electrical snap-action switches have the disadvantage that, if one spring arm breaks, connected contact pairs cannot be spaced apart from each other safely so as to avoid the respective switch positions. Hence, snap-action switches are known in practice, where a specific end position of the contact bridge is to be obtained in the event of a spring fracture, in which neither the contact pairs of the first nor those of the second switch position are connected to each other.

An electrical snap-action switch is disclosed in DE 296 14 028 U1, wherein, if a spring arm breaks, a contact bridge is transferred into an end position avoiding the first and/or second switch position in such a way that the contact bridge is displaced transversely to the direction of movement of the switching plunger and is tilted upon subsequently abutting against a stop edge due to the momentum acting on the contact bridge. In this end position neither the first nor the second switch position is active. Thus, if one spring arm breaks, it is possible to avoid the current flow in the first and/or second switch position and achieve a great opening safety.

However, it is a drawback of the solution shown in DE 296 14 028 U1 that the momentum applied to the contact bridge when a spring arm breaks is relatively small. If there are additional forces acting externally on the snap-action switch, and accelerating the snap-action switch, the momentum for opening the switch position permanently is not sufficient. Especially if dynamic movements occur it may happen that an undesired displacement and/or rotation of the contact bridge takes place and results therewith in a switch position that was not intended.

Therefore, it is the object of the present invention to configure an electrical snap-action switch in such a way that a forced opening avoiding a first and/or a second switch position is ensured, even if the snap-action switch is subjected to dynamic movements.

This object is solved by providing a sliding ramp in the movement path of the contact bridge, which sliding ramp spaces apart at least one contact of the contact bridge in the movement end position from the associated contact of the respective contact pair in the event of breakage of one spring arm.

Thus, it is possible that directly after the breakage of one spring arm and the displacement of the contact bridge resulting therefrom both the first and the second switch positions of the snap-action switch are avoided. Upon sliding on the sliding ramp arranged in the movement path of the contact bridge the contact bridge is spaced apart from the contact pair of the first and/or second switch positions. Furthermore, the undamaged spring arm acts on the contact bridge to ensure a forced opening of the snap-action switch, even in the event of forces acting externally on the snap-action switch, in particular dynamic forces.

Advantageous embodiments are claimed in the dependent claims and will be explained below.

It is a further advantage that the sliding ramps on the contact bridge are arranged on both sides of the switching plunger. The arrangement of the sliding ramps on the contact bridge permits a simple configuration of the sliding ramps. Moreover, a distribution of the sliding ramps on both sides of the switching plunger ensures that the contact bridge is spaced apart from the respective contact pairs, regardless of the direction of movement of the contact bridge which is directed transversely to the switching plunger.

In another embodiment it is an advantage that the contact bridge comprises two contact carriers which run substantially parallel towards each other and which are spaced apart and connected by at least two electrically insulating spacers, wherein the spacers are arranged on both sides of the switching plunger and the sliding ramps are formed by ends of the spacers protruding over the contact carriers. The configuration of the sliding ramps in such a way further reduces the production expenditure for the sliding ramps. Furthermore, each contact of the contact pairs can be spaced apart from the contact bridge by a separate sliding ramp.

It is positive if the sliding ramps are made of an electrically insulating material, as an undesired current transition between the contact pairs of the different switch positions is thus avoided.

If the sliding ramps are substantially wedge-shaped the distance between the contact bridge and the respective contact pair changes constantly as the movement path increases when the contact bridge is displaced transversely to the direction of movement of the switching plunger. Thus, jerky movements of the contact bridge during the displacement can be avoided and a uniform guidance of the contact bridge into the movement end position is ensured.

Advantageously, the contacts of the contact pairs can be realized with a slope which faces the respective sliding ramp. Accordingly, the risk that the contact bridge or the sliding ramp associated with this contact bridge gets wedged with the respective contact of the contact pair is minimized.

If the slopes have a continued curvature, the slope can easily be realized by machining the respective contact to obtain a bend.

In an advantageous embodiment it is conceivable that the contacts of the contact pairs are each realized with two contact flanks running towards each other substantially v-shaped, wherein the contact flanks are each joined by a horizontal supporting surface on which the corresponding sliding ramp lies face to face in a movement end position. This face-to-face support can prevent the contact bridge from tilting under dynamic use conditions of the snap-action switch.

Figure 2:
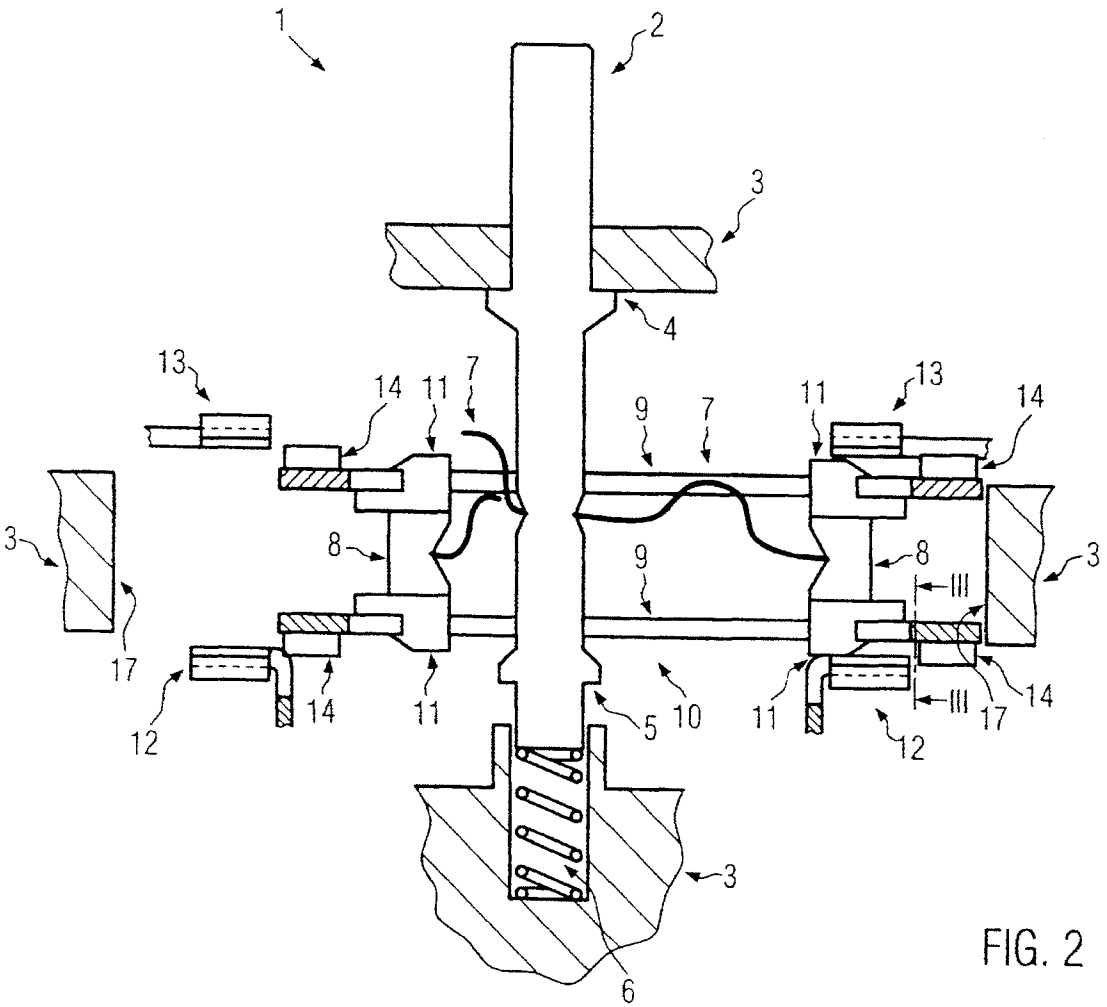
Figure 3:
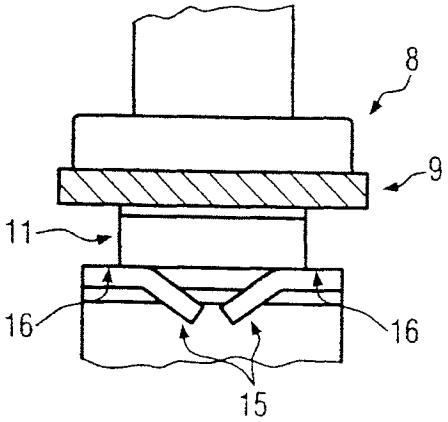

The invention will be explained by means of an embodiment below, with the aid of figures in a drawing. In the drawing:

FIG. 1 shows a cross-section through the snap-action switch according to the invention in a rest position as the first switch position, FIG. 2 shows the snap-action switch of FIG. 1 immediately after one of the spring arms broke, and FIG. 3 shows a detailed view of a section along plane of FIG. 2.

The figures are merely of a schematic nature and only serve the understanding of the invention. Like elements are designated with like reference numerals.

The electrical snap-action switch 1 as illustrated in FIGS. 1 and 2 comprises a switching plunger 2 which is arranged centrally in a casing 3 and is mounted to be axially displaceable in two areas of the casing 3. An upper and a lower stop area 4 and 5 on the switching plunger 2 define the movement path of the switching plunger 2. In the rest position shown in FIG. 1 the switching plunger 2 is held in an upper position, which is induced by the spring force of a spring member 6, in which position the upper stop area 4 is in contact with the casing 3.

Approximately in the center of the switching plunger 2 two opposite notches are provided on the switching plunger 2. Each of these notches serves to receive one of the ends of two catch springs 7 which are arranged on both sides of the switching plunger 2. The two catch springs 7 are configured as two substantially omega-shaped spring arms and are arranged substantially symmetrically relative to the direction of movement of the switching plunger 2.

The other ends of the catch springs 7 are, in turn, each supported in a notch of a spacer 8. The two spacers 8, which are also arranged on both sides of the switching plunger 2, form together with two contact carriers 9 a contact bridge 10. Apart from connecting the contact bridge 10 to the catch springs 7 the spacers 8 serve to receive the two contact carriers 9 which run substantially parallel towards each other. The respective ends of the spacers 8 protruding over the contact carriers 8 are each formed as sliding ramps 11. The sliding ramps 11 have a flank running substantially wedge-shaped and a supporting area running substantially horizontally.

In the rest position of the snap-action switch 1 shown in FIG. 1 the contact bridge 10 is connected by a contact carrier 9 to a first contact pair 12. At the same time, the other contact carrier 9 is spaced apart from a second contact pair 13. In the contact area between the contact carriers and the respective contact pairs 12 and 13, moreover, individual contact members 14 are arranged on the contact carriers 9. Furthermore, the contacts of the first contact pair 12 are partially bent, so that a curved slope is provided in these areas. As can further be seen in FIG. 3, the respective contact of the contact pairs 12 and 13 comprises two contact flanks 15 which run towards each other substantially v-shaped and which change into a separate, horizontal support area 16.

In addition, displacement limit stops 17 opposing the end faces of the contact carriers 9 are provided on the casing 3, which limit the movement path of the contact bridge 10 that runs transversely to the direction of movement of the switching plunger 2.

In terms of function the spring arrangement comprising the catch springs 7 is oriented such that when the switching plunger 2 is displaced transversely to the contact bridge 10 the contact bridge 10 snaps over when a snap-over point is exceeded. For switching the second switch position the switching plunger 2 is moved by an actuating force opposite to the spring force of the spring member 6, while the position of the catch springs 7 changes at the same time. Once the snap-over point is reached, which is predefined by the construction of the catch springs 7, the contact bridge 10 snaps over into a second switch position. In this second switch position a second contact pair 13 is connected by a contact carrier 9 and the other contact carrier 9 is spaced apart from the first contact pair 12. If the actuating force externally applied to the switching plunger 2 is interrupted subsequently the switching plunger 2 is again pushed upwardly due to the action of the force of the catch springs 7, so that finally the contact bridge 10 snaps over back into the first switch position.

FIG. 2 further illustrates the behavior of the electrical snap-action switch 1 according to the invention immediately after one of the catch springs 7 broke. After the breakage of a catch spring 7 the contact bridge 10 is displaced transversely to the direction of movement of the switching plunger 2 until the sliding ramps 11 according to FIG. 2 come to bear against at least one contact of a contact pair 12 or 13 in a movement end position. While the broken catch spring 7 can no longer exert any force on the contact bridge 10 after it broke, the undamaged catch spring 7 relaxes and, therefore, displaces the contact bridge 10 transversely to the direction of movement of the switching plunger 2 as a result of the changing equilibrium of forces. During the displacement of the contact bridge 10 the abutting of the sliding ramp 11 against a contact of a contact pair 12 or 13 results in a sliding of the flank of the sliding ramp 11, which is arranged substantially wedge-shaped, and thus in lifting the contact bridge 10 from the respective contact of the contact pair 12 or 13. The abutting at the curved slope of the contact of the contact pair 12 or 13 further minimizes the risk of the sliding ramp and the contact getting wedged. In the movement end position the sliding ramp 11 finally bears with a substantially horizontally running supporting area face to face against the horizontal supporting surface 16 of the contact of a contact pair 12 or 13. The movement path is here substantially influenced by the spring properties of the respective undamaged catch spring 7. For a further limitation of the movement path of the contact bridge 10, moreover, a displacement limit stop 17 is provided on the casing 3, against which the end faces of the contact carriers 9 abut as the contact bridge 10 is further displaced. In another embodiment it is also possible to configure the end faces of the contact carriers 9 such that they already bear against the respective limit stop 17 in the movement end position.

The detailed view of FIG. 3 demonstrates the face-to-face contact between the sliding ramp 11 and the contact of the first contact pair 12. To this end, the contact comprises two contact flanks 15 running towards each other substantially v-shaped, and two horizontal supporting surfaces 16 adjacent to these contact flanks 15, which bear against the horizontal supporting area of the sliding ramp 11 face to face in the illustrated movement end position.

The invention claimed is:

1. An electrical snap-action switch, comprising:

a contact bridge which can be actuated by a switching plunger and a bistable spring arrangement and which is connectable in a first switch position to at least one first contact pair and in a second switch position to at least one second contact pair, wherein the spring arrangement has at least one spring arm on each of two sides of the switching plunger, by means of which, in addition, the contact bridge is movable transversely with respect to a movement direction of the switching plunger up to a movement end position in the event of breakage of one of the spring arms, wherein a sliding ramp is provided in a movement path of the contact bridge, which sliding ramp spaces apart at least one contact of the contact bridge in the movement end position from the associated contact of the respective contact pair in the event of breakage of one spring arm.

2. The electrical snap-action switch according to claim 1, further comprising an additional sliding ramp on the contact bridge, wherein the sliding ramp and the additional sliding ramp are arranged on both sides of the switching plunger.

3. The electrical snap-action switch according to claim 2, wherein the contact bridge comprises two contact carriers which run substantially parallel towards each other and which are spaced apart and connected by at least two electrically insulating spacers, wherein the spacers are arranged on both sides of the switching plunger and the sliding ramps are formed by ends of the spacers protruding over the contact carriers.

4. The electrical snap-action switch according to claim 1, wherein the sliding ramp is made of an electrically insulating material.

5. The electrical snap-action switch according to claim 1, wherein the sliding ramp is substantially wedge-shaped.

6. The electrical snap-action switch according to claim 1, wherein each of the contacts of the contact pairs comprises a slope which faces the respective sliding ramp.

7. The electrical snap-action switch according to claim 6, wherein each of the slopes has a curvature.

8. The electrical snap-action switch according to claim 1, wherein each of the contacts of the contact pairs comprises two contact flanks running towards each other substantially v-shaped, wherein the contact flanks are each joined by a horizontal supporting surface on which the corresponding sliding ramp lies face to face in the movement end position.

9. An electrical snap-action switch, comprising:

a switching plunger which is movable in a movement direction;

a bistable spring assembly comprising a first spring on a first side of the switching plunger and a second spring on a second side of the switching plunger;

a contact bridge configured to be actuated by the switching plunger and the bistable spring assembly, wherein the contact bridge is connectable in a first switch position to at least one first contact pair and in a second switch position to at least one second contact pair, wherein the contact bridge is movable transversely with respect to the movement direction of the switching plunger up to a movement end position in the event of breakage of one of the spring arms; and a sliding ramp, disposed in a movement path of the contact bridge, wherein the sliding ramp spaces apart the contact bridge in the movement end position from the associated contact of the respective contact pair in the event of breakage of the one of the spring arms.

10. The electrical snap-action switch according to claim 9, wherein the sliding ramp is disposed on the first side of the switching plunger, further comprising an additional sliding ramp disposed on the contact bridge on the second side of the switching plunger.

11. The electrical snap-action switch according to claim 10, wherein the contact bridge comprises two contact carriers which are substantially parallel to each other and which are spaced apart and connected by at least two electrically insulating spacers, wherein a first one of the spacers is disposed on the first side of the switching plunger, a second one of the spacers is disposed on the second side of the switching plunger, and the sliding ramps are disposed on ends of the spacers.

12. The electrical snap-action switch according to claim 9, wherein the sliding ramp comprises an electrically insulating material.

13. The electrical snap-action switch according to claim 9, wherein the sliding ramp is substantially wedge-shaped.

14. The electrical snap-action switch according to claim 9, wherein each of the contacts comprises a sloped surface which faces the respective sliding ramp.

15. The electrical snap-action switch according to claim 14, wherein each of the sloped surfaces is curved.

16. The electrical snap-action switch according to claim 9, wherein each of the contacts comprises two contact flanks cooperating to define a V shape, wherein the two contact flanks are joined by a horizontal supporting surface on which the corresponding sliding ramp lies in the movement end position.

* * * * *